United States Patent [19]

Rope et al.

[11] Patent Number: 4,964,751

[45] Date of Patent: Oct. 23, 1990

[54] DUCKBOARD

[75] Inventors: Christopher C. Rope; Pamela A. Rope, both of Watton, England

[73] Assignee: Handbury Limited, Norfold, England

[21] Appl. No.: 179,082

[22] Filed: Apr. 8, 1988

[30] Foreign Application Priority Data

Apr. 9, 1987 [GB] United Kingdom ..... 8708539

[51] Int. Cl.[5] ..... E01C 9/08

[52] U.S. Cl. ..... 404/35; 238/14

[58] Field of Search ..... 238/14; 404/35, 36, 404/40; 14/1; 403/165

[56] References Cited

U.S. PATENT DOCUMENTS

| | | | |
|---|---|---|---|
| 1,325,575 | 12/1919 | Niewoehner | 404/35 X |
| 2,225,828 | 12/1940 | Godschall | 238/14 |
| 2,422,006 | 6/1947 | Friedman | 238/14 |
| 3,350,013 | 10/1967 | Bergquist | 238/14 |
| 3,425,624 | 2/1969 | Jacobs | 238/14 |
| 3,820,912 | 6/1974 | Hughes | 404/35 |
| 4,023,803 | 5/1977 | Lewis | 403/165 X |
| 4,047,257 | 9/1977 | Bondarchuk, Sr. | 404/35 X |
| 4,681,482 | 7/1987 | Arciszewski et al. | 404/35 |

*Primary Examiner*—Jerome W. Massie
*Assistant Examiner*—Matthew Smith
*Attorney, Agent, or Firm*—Neal J. Mosely

[57] ABSTRACT

A duckboard comprising a succession of treads (11) linked so as to rest, in use, in generally parallel non-co-axial corresponding-end-alignment along the ground or other surface on which the board is placed: and characterized by the features, firstly that the board is flexible enough to be rolled end-to-end; secondly, that it is light enough to be relatively portable; and thirdly, that the means (12) linking the treads (11) are resilient enough and/or rigid enough to tend to maintain the parallelism and the end-alignment of the treads (11) in use.

15 Claims, 3 Drawing Sheets

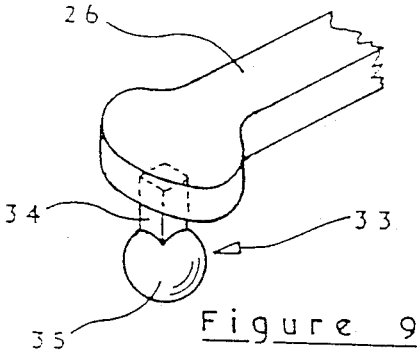
Figure 9
Figure 10
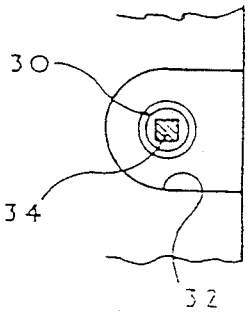
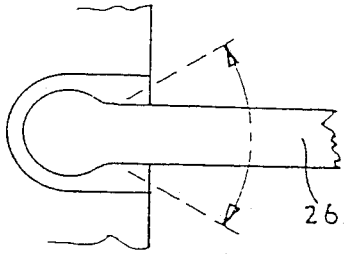
Figure 11
Figure 12A
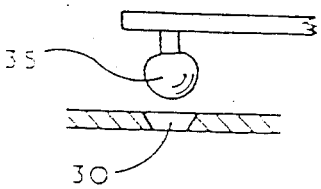
Figure 12B
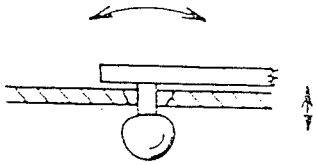
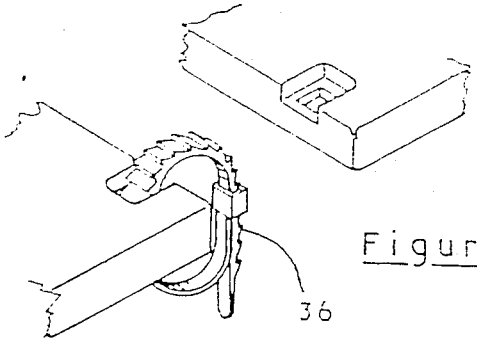
Figure 13

DUCKBOARD

BACKGROUND TO THE INVENTION

The invention relates to duckboards.

A duckboard is a length of board laid, in use, on a surface—such as the ground—over which men, materials and/or equipment have to walk, be dragged and/or wheeled.

The purpose of conventional duckboards is to make the passage of the men, materials and/or equipment easier and/or safer than it would be without the use of the board. For example, the ground-engaging wooden duckboard gives a man a firm-footed passage over boggy ground, and reduces the dangers of him slipping or sinking if the board were not present. And as a similar example, the conventional roof crawling board spreads a man's weight over a greater area than that of the roof struts which, without the board present, could not withstand the pressure of his weight on their own relatively small area.

These conventional duckboards are widely used. But their use is largely confined to the building industry. They are essentially rigid structures, and they are also relatively heavy. They tend to be quite large. For all these reasons, they are not easily portable, nor can they be stacked or transported in relatively confined spaces.

The commercial building industry accepts that its equipment will, in general, be heavier, more bulky, and less easily carried, than the equipment which the amateur "do it yourself" builder or gardener seeks to use. Building has always been essentially a heavy labouring job. The rigidity, weight, and size of conventional duckboards has therefore not received any inventive attention. Whether they are used outdoors, (as in the two examples given above) or indoors (in a gymnasium for example), duckboards have always been relatively rigid, large, and heavy; and there has been no reason to think of altering these basic qualities.

The commerical builder may accept readily enough that duckboards are one of the items of equipment in which he must invest, and which he must be prepared to carry around with him from site to site. The amateur builder or gardener, without the muscle power or the storage space available to the professional, does not view them in the same light. There are many instances when he could use the advantages of a duckboard or a line of duckboards laid end-to-end. For example, when barrowing earth across his lawn to and from his garden compost heap. He may to so far as to use planks, laid end-to-end, if he has these available to protect his lawn. He is more likely, either not to have them available, or to be unwilling to wrestle with them every time he needs to run a heavy barrow over his turf.

There is, in the example just given, a clear need for some form of duckboard which the amateur would be willing to buy and to use. But it is equally clearly a need to which conventional duckboards provide no solution. They are too heavy, too big, and too rigid to be used by the amateur. But the professional who does use them sees no good reason why he should seek to alter them for his purposes.

In a situation where an amateur builder or gardener requires the use of a duckboard, if it is to be of use to him it will have to be light enough for him to be able to readily lift and transport manually the whole assembly himself.

An embodiment of the duckboard of the invention may be used in situations where a temporary roadway may be required over a poor surface such as for use in tranporting emergency relief in third world countries. In such cases, the duckboard can usefully be heavier than that used by a gardener but still needs to be light enough to be easily lifted by a few men and easily transported by a lorry also carrying other goods. In the following specification the term "relatively portable" will be taken to mean light enough to be portable and useful for its required intended purpose.

SUMMARY OF THE INVENTION

The invention provides a duckboard which comprises a succession of treads linked so as to rest, in use, in generally parallel non-co-axial corresponding-end-alignment along the ground or other surface on which the board is placed; and characterized by the features, firstly that the board is flexible enough to be rolled end-to-end; secondly, that it is light enough to be relatively portable; and thirdly, that the means linking the treads are resilient enough and/or rigid enough to tend to maintain the parallelism and the end-alignment of the treads in use.

Such a board differs from a conventional wooden ground-engaging duckboard by virtue of its flexibility and its relatively light weight, irrespective of whether or not the conventional duckboard—as it may have—has parallel end-aligned treads. It differs from the conventional roof crawling board in the same respects. And it differs from, say, a conventional rope ladder laid in use on the ground, in that the ropes linking the treads of such a ladder are neither resilient enough nor rigid enought to tend to maintain the parallelism and the end-alignment of the ladder treads when subject to the use for which the duckboard is intended. It is therefore new.

Such a duckboard also does not form any obvious development of the state of the art in duckboards generally. Taking the known art, and the problem that it presents, in the terms already reviewed, provides no apparent basis for arriving at the present invention. Conventional duckboards are neither readily stored nor readily portable for the amateur, but the professional has never had any need to change either of these features. Rope ladders have been known for as long as conventional duckboards, and are easily rolled for storage and light in weight for easy portability. But they are quite unsuited to use as a duckboard and therefore there is no obvious reason to consider the teachings that they represent when one has been told to try to modify the conventional duckboard. And even if one is told to consider applying the features of the rope ladder to the conventional duckboard, there is no immediately apparent means of doing so with advantage.

The invention, therefore, is believed to involve an inventive step over the most relevant art currently known to the applicant.

In a duckboard embodying the invention, the means linking the treads may comprise lengths of resilient material spacing the treads one from another in use. This allows compact rolling of the duckboard, possibly "carpet-fashion" (i.e. end-over-end instead of just end-to-end).

It is preferred that the treads and the means linking the treads are arranged such that they can be readily coupled together in situ to allow the assembly of the duckboard. This allows sale of the duckboard in self-assembly "flat-pack" form; and ready assembly of any desired length of duckboard.

Conveniently when the means linking the treads are lengths of resilient material, these "linking strips" snap-fit into bores in the treads.

Alternatively the means linking the treads may comprise conventional saw-tooth plastics cable straps which can be readily used to couple two treads together in situ. Once such straps are in position, they can only be disconnected by cutting the straps and thus, in this case, once the duckboard is assembled it cannot readily be dismantled.

Where the connection between the treads and the linking strips is a snap-fit, it is preferred that the snap-in ball is coupled to the linking strip by a stalk of cross-section smaller than the cross-section of the bore in the tread. This enables the linking strip and hence adjacent treads to move with limited movement relative to one another, irrespective of the flexibility/rigidity of the linking strip itself.

It has been found that a stalk of square cross-section is preferred to a stalk of circular cross-section.

Preferably the bore in the tread is tapered. This allows for a smooth snap-action but tends to retain the ball in place. It is possible to arrange the snap-fit so as to be readily detachable or such that once connected the disconnection is difficult or impossible.

In a preferred arrangement the stalk of the snap-in ball is longer than the bore of the tread. This allows the linking strip to float up and down in relation to the tread to accommodate irregularities in ground surface.

Preferably each tread also includes means to link it with a further tread arranged co-axially with the tread so that not only can the duckboard have its length increased but it can also have its width increased by adding another run of treads.

One or more of the treads may incorporate, or be adapted to incorporate, ground-engaging pegs. Where a duckboard embodying the invention is laid along the ground, it will tend to sink into the ground and stay in place with repeated use. But pegging its end tread (for example) will help to ensure that it does stay in place during use.

The ground-engaging surface of each tread is preferably either generally concave or substantially flat. Whilst the ground-engaging surface could, within the broadset aspect of the invention, be convex—for example, the treads could be circular-cylindrical-section bars—a concave substantially flat ground-engaging tread surface will grip the ground better in use; and the duckboard will tend more to stay in place.

The top surface (i.e. the non-ground-engaging surface) of each tread may be partially or substantially wholly ribbed or otherwise treated to improve the grip of whatever or whoever contacts that surface in use. The advantages of such surface treatment are self-evident in themselves. But it is not obvious to apply them to a duckboard embodying the invention, in which it would more naturally be thought that the provision of successive individual treads would in itself provide sufficient grip for whatever travels over them in use.

The bottom surface (i.e. the ground-engaging surface) of each tread may with advantage be treated to improve the grip of the tread on the ground in use. Here again, the advantages of such treatment are known in themselves, but using it to improve a duckboard embodying the invention involves an inventive step; because separate treads would normally be assumed to sink in use into the ground and so to be already sufficiently gripping the duckboard into place.

Preferably the treads and the means linking the treads are injection moulded plastics. In one embodiment of the invention the tread comprises a foamed plastics core surrounded by a harder wearing plastics outer shell, for example a polyurethane shell surrounding a cellular plastics core.

The invention also includes within its scope a tread intended for use as part of a duckboard embodying the invention in any of the aspects summarized above.

BRIEF DESCRIPTION OF THE DRAWINGS

Two duckboards in accordance with the invention, together with possible modifications thereof will now be described by way of example only, with reference to the accompanying drawings, in which:

FIG. 9 is an enlarged perspective view of a feature of the means linking the treads of FIG. 7;

FIG. 10 is an enlarged plan view of a feature of the duckboard of FIG. 7;

FIG. 11 is an enlarged schematic view of a feature of the duckboard of FIG. 7;

FIGS. 12A and 12B show schematically the means for linking the treads of the second duckboard together, and, FIG. 13 is a schematic perspective view of an alternative means for linking the treads together.

DESCRIPTION OF THE PREFERRED EMBODIMENT

Figure 1:
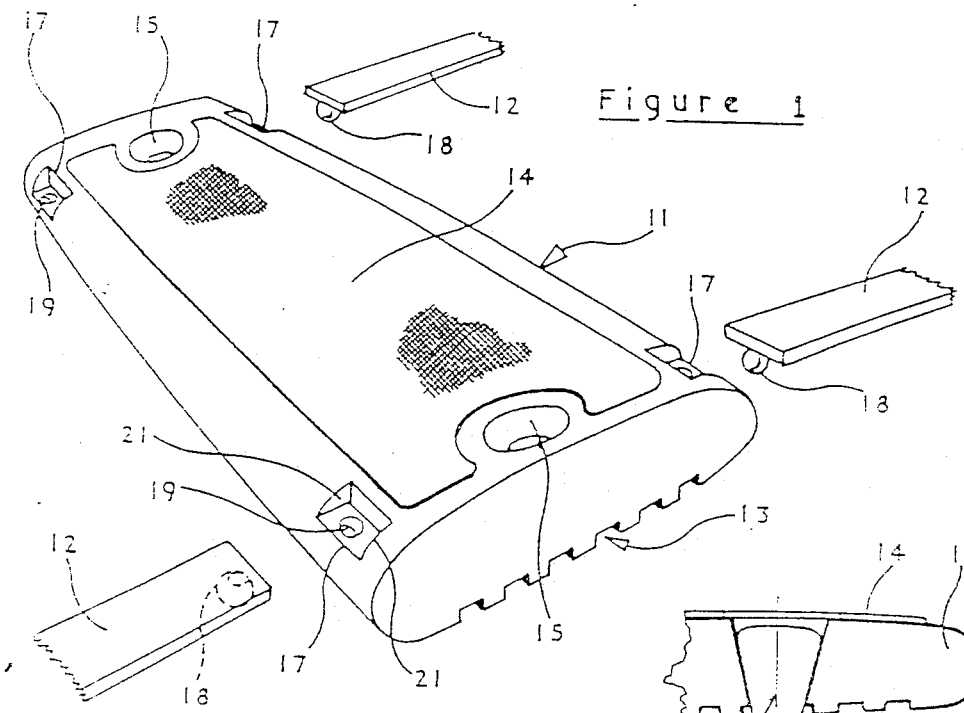
FIG. 1 of the drawings shows in "exploded" perspective, one tread and several adjacent lengths of tread-linking material, forming a portion of a first duckboard embodying the invention.

The duckboards shown in the drawings are only examples of forms which the invention might take within its broadest aspect.

The first duckboard, shown in FIGS. 1 to 5 consists essentially of a succession of flat elongate treads 11 linked, and spaced apart, ladder-fashion by lengths of resilient material 12 which are readily detachable from the treads and are sold, initially, in a self-assembly "flat-pack" packaged bundle with the treads.

As FIG. 1 shows, each tread 11 is rectangular in plan, and generally rectangular but with rounded ends in end elevation. That surface of the tread which, in use, will engage the ground, is ribbed as indicated at 13. The non-ground-engaging surface of the tread is overlaid with a roughened coating 14. The ribs 13 are spaced apart across the bottom surface of the tread, and run parallel along the length of that surface. The roughened coating 14 comprises a gritted sheet wich is glued firmly to the tread top surface and which covers substantially the whole of that surface.

Figure 1B:
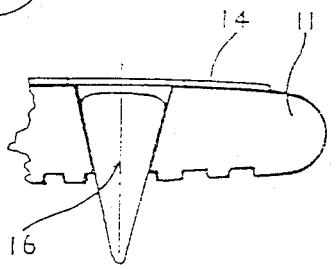
FIGS. 1A and 1B show respectively, in sectioned part-elevation features of the tread in FIG. 1.

Each tread 11 such as the one illustrated is adapted to incorporate ground-engaging pegs, by virtue of two holes 15 each running through the tread from its top surface to its bottom surface. The centre line of each of these holes 15 lies on the longitudinal axis about which the tread 11 is symmetrical in plan. And as FIG. 1B shows, the holes 15 taper regularly from the top surface to the bottom surface of the tread 11 to accept respective conical pegs 16 in use.

The treads 11, of which there are as many as is desired to constitute an adequate overall length of duckboard, are recessed as indicated at 17 in FIG. 1 to accept the ends of the resilient strips 12. Each of these strips 12 is rectangular, elongate and substantially flat. Each end of each such strip has a ball 18 formed integrally with the strip and projecting from the underside of the strip. The ball is a snap-fit in a hole 19 formed in the recess 17 which accepts the strip end.

The treads 11 are moulded from relatively rigid plastics material. The strips 12 are also relatively rigid plastics strips but, because they are thin in comparison with the thickness of the tread 11, each strip can flex resiliently to a limited extend about an axis running across the strip, whilst remaining substantially inflexible about the longitudinal axis of the strip.

When the strip 12 are snap-fitted into the treads 11, to link successive treads in parallel spaced-apart corresponding-end-alignment, the frictional fit of each ball 18 into its hole 19 is sufficient for the strips not to spring out of the recesses 17 (unless of course the assembly of treads and strips is flexed quite abnormally beyond its intended useage). But a determined pull on any individual strip-end will dislodge the ball 18 from the hole 19 so that the strips can be readily detached from the treads.

Because the strips 12 are substantially inflexible about their respective longitudinal axes, and are also substantially not distortable from their elongate rectangular form; and because the side walls 21 of each recess 17 are long enough to contact an appreciable portion of each rectangular strip-end; then the overall result is that the resilient strips 12 allow the overall assembly to flex to a limited extent but tend to maintain the treads 11 in parallelism and in end-alignment.

Figure 3:
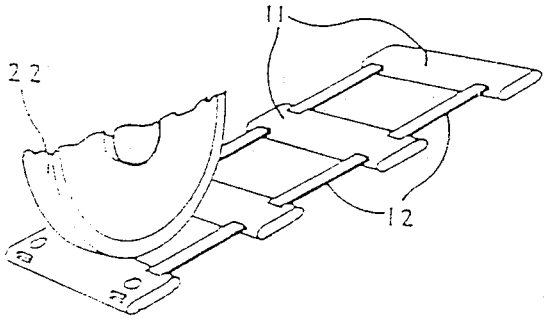
FIG. 3 likewise shows in diagrammatic perspective another aspect of the use of the duckboard.
Figure 1A:
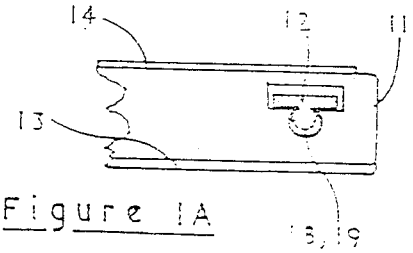
Figure 2:
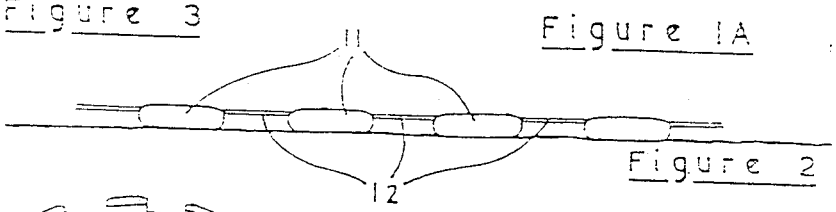
FIG. 2 shows a portion of the first duckboard diagrammatically, in elevation in use along the ground.
Figure 5:
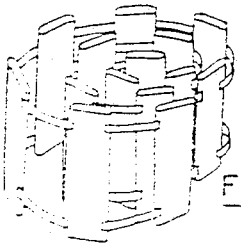
FIG. 5 shows a longer duckboard, again embodying the invention, rolled carpet-fashion.
Figure 4:
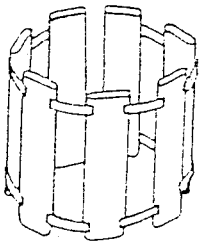
FIG. 4 shows the duckboard rolled end-to-end.

As FIGS. 2 and 3 show, when the duckboard comprising the assembly of treads 11 and strips 12 is laid along the ground, the wheel 22 of a garden barrow (not shown) can be run along it without damaging the ground itself. As FIG. 4 shows, a basic length of duckboard can be rolled end-to-end. And as FIG. 5 shows, a longer length can be rolled carpet-fashion.

The duckboard described and illustrated can be used to run garden barrows across lawns, up curbs, and to form a track across any other soft but not wholly waterlogged terrain. It could be permanently left in place, in certain circumstances, and grass growing up around it could be mown to just above the level of the tread surfaces 14 by a ground-cushion-travelling mower of the FLYMO kind (FLYMO is a trade mark).

It could equally possible be used as a track against which the driven wheels of a bogged-down vehicle, stranded for example in mud or in snow, could grip.

In practical use, preferably the treads 11 are sufficiently close to one another that the wheel of the barrow or other item of equipment using the duckboard does not contact the ground in between successive treads as it travels along the duckboard.

Figure 6:
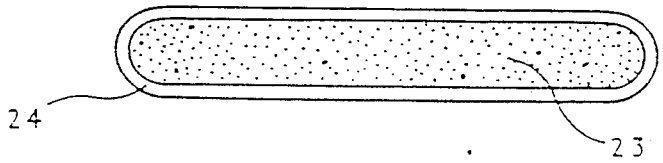
FIG. 6 shows a section through a modification of the tread shown in FIG. 1.
Figure 7:
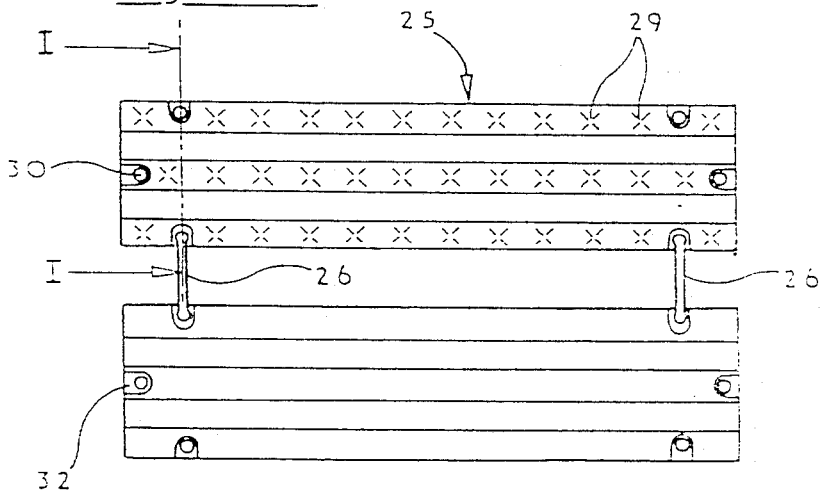
FIG. 7 is a schematic plan view of two treads of a second duckboard.

In cases where the duckboard is to be used to support trucks or lorries, the treads have to be strong. They can therefore have the construction shown in FIG. 6. Here each tread comprises a core 23 of cellular plastics with a hardwearing outer shell 24 of polyurethane. The treads may typically here be 6 ft or 8 ft (1.83–2.44m) long.

In cases where the duckboard is to be used in gardens only the treads can be much shorter (for example 0.25–0.5m) to make them easier to handle. They can also be made of a hollow shell since they only have to support the weight of a man, or a garden barrow.

The second duckboard shown in FIGS. 7 to 12B is suitable for use in a garden. The duckboard is made up of a plurality of treads 25 which are elongate and generally rectangular in plan. These treads 25 are linked by lengths 26 of resilient material.

The linking strips 26 and treads 25 can readily be connected together and are sold initially in a self-assembly flat pack. If the duckboard needs to be extended either lengthways or widthways, further flat packs can be bought and readily connected to the existing duckboard.

Figure 8:
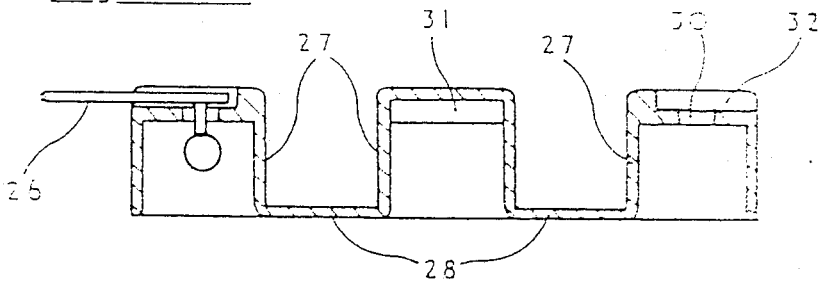
FIG. 8 is a sectional elevation along line I—I of FIG. 7.

Each tread 25 and linking strip 26 is made from injection moulded plastics material. Each tread 25 is ribbed in construction as can be seen in FIG. 8 and consists of three open edged channels 27 coupled by linking members 28.

This gives a good gripping surface on the ground engaging surface and the non-ground engaging surface. The non-ground engaging surface has a plurality of slight projections 29 which serve to roughen this surface to provide a non-slip surface.

Each tread 25 includes six bores 30. The tread includes a portion of thickened cross-section 31 wherever a bore is to be cut. Into each portion 31 is cut a slot 32. This allows the end of the linking strip 26 to sit beneath the upper surface of the tread as is shown in FIG. 8.

The tread includes two spaced-apart bores 30 along each of its elongate edges, and when two linking strips 26 extend between two pairs of bores 30 of adjacent treads 25, the treads 25 are held in a generally parallel non-coaxial corresponding-end-aligned relationship.

When the duckboard needs to have its width extended the bores 30 at the ends of each tread can be used to couple a further run of treads to the existing duckboard.

FIG. 9 shows in detail the end of a linking strip 26. Each strip 26 has integrally moulded at each of its ends a projection 33, consisting of a stalk 34 of square cross-section and a ball 35.

The ball 35 is a snap-fit into bore 30 as shown in detail in FIGS. 12A and 12B.

The bore 30 tapers to tend to retain the ball 35 in position.

The cross-section of stalk 34 is smaller than the diameter of bore 30, as shown in FIG. 10 and therefore the linking strip 26 can "waggle" about relative to the tread 25 as shown in FIG. 12B.

The swivel allowed by the rotation between stalk 34 and bore 30 is limited by the strip 26 bearing against the wall of the slot 32 as shown in FIG. 11.

The length of stalk 34 is longer than bore 30 to allow each strip 26 to be able to float up and down with respect to the tread 25.

The arrangement is such that once the ball 35 has been snapped through bore 30, it is not readily removeable in fact in many cases it is impossible. Thus there is no danger of the duckboard coming apart in use.

In an alternative embodiment, the means linking the treads 25 can be provided by saw-tooth plastics cable straps 36 as shown in FIG. 13. These can readily be coupled to the treads and once in position would have to be cut in order to dismantle the duckboard.

We claim:

1. A duckboard comprising a plurality of elongate tread members substantially rectangular in plan, and including a ground engaging surface and a non-ground engaging surface, said tread members each having connection means adjacent the ends of opposing side edges of the non-ground engaging surfaces, a plurality of connecting strips for connecting pairs of tread members, said strips being flexible along their thin dimension and rigid along their width, means on the ends of each strip for removably securing the same to said connection means on adjacent tread members to hold a plurality of said tread members in parallel fixed relation and spaced apart by the length of said strips and with the ends of said tread members being aligned, whereby, in use, the treads rest on a surface on which the board is placed with the non-ground engaging surfaces of the treads maintained substantially parallel and uniformly spaced by said strips, said duckboard having sufficient flexibility to be rolled end-to-end, being light enough to be hand carried, and the length of the duckboard being readily extended or shortened in situ by the addition or removal of tread members and connecting strips.

2. A duckboard in accordance with claim 1, in which said tread members are of a light-weight molded or formed thermoplastic material.

3. A duckboard in accordance with claim 2, in which said tread members have a molded or formed thermoplastic shell filled with cellular plastic material.

4. A duckboard in accordance with claim 1, in which said tread members are substantially rectangular in cross-section with rounded ends.

5. A duckboard in accordance with claim 1, in which the ground-engaging surface of said tread members is ribbed.

6. A duckboard in accordance with claim 1, in which the non-ground-engaging surface of said tread members is coarse.

7. A duckboard in accordance with claim 1, in which said tread members are corrugated, with squared corrugations, providing a ribbed, ground-engaging surface.

8. A duckboard in accordance with claim 1, in which said tread members have connection means on opposing end edges of the non-ground engaging surface for connection in side-to-side relation by some of said connecting strips.

9. A duckboard in accordance with claim 1, in which said tread members are corrugated, with square corrugations, providing a ribbed, ground-engaging surface, and said tread members have a rectangular recesses on opposing side and end edges of the non-ground engaging surface of said corrugations for connection both in parallel and in side-to-side relation by some or said connecting strips.

10. A duckboard in accordance with claim 1, in which at least one of said tread members has a tapered aperture therethrough and a tapered ground-penetrating peg positioned therein.

11. A duckboard in accordance with claim 1, in which said strip-securing means comprises a snap-fitting member on the end of each strip and a snap recess in each of said rectangular recesses.

12. A duckboard in accordance with claim 11, in which said snap-fitting member comprises a snap-in ball supported on said connecting strip by a stalk, and each snap recesses includes a bore through which the snap-in ball passes, in which the cross-section of the stalk is smaller than the cross-section of said bore.

13. A duckboard in accordance with claim 12, in which said stalk has a length which is longer than the depth of said bore.

14. A duckboard in accordance with claim 12, in which said bored is a tapered hole to tend to retain said snap-in ball in place.

15. A duckboard in accordance with claim 1, in which said tread members each having rectangular recesses adjacent the ends of opposing side edges of the non-ground engaging surfaces constituting said connection means, securing means on the ends of each strip securing the same in said rectangular recesses of adjacent tread members to hold a plurality of said tread members in parallel, fixed spaced relation with the ends of said tread members being aligned.

* * * * *